US005351584A

United States Patent [19]

Warheit

[11] Patent Number: 5,351,584

[45] Date of Patent: Oct. 4, 1994

[54] PLIER TOOL ASSEMBLY

[76] Inventor: William A. Warheit, 121 Iroquois Dr., Butler, Pa. 16001

[21] Appl. No.: 40,912

[22] Filed: Mar. 25, 1993

Related U.S. Application Data

[63] Continuation of Ser. No. 804,911, Dec. 11, 1991, abandoned.

[51] Int. Cl.[5] ..... B25B 7/04

[52] U.S. Cl. ..... 81/407; 81/413; 81/416; 81/314

[58] Field of Search ..... 81/405–413, 81/416, 417, 427, 393, 394, 385, 314, 355, 356, 357, 359, 360, 900; 76/114, 119, DIG. 6

[56] References Cited

U.S. PATENT DOCUMENTS 1,577,155 3/1926 Anderson ..... 81/412
1,739,715 12/1929 Eckland ..... 76/114 X
4,651,598 3/1987 Werheit ..... 81/407
4,662,252 5/1987 Werheit ..... 81/341
4,819,521 4/1989 Leng ..... 81/177.1 X

FOREIGN PATENT DOCUMENTS 1016650 9/1957 Fed. Rep. of Germany ..... 81/416

*Primary Examiner*—D. S. Meislin
*Attorney, Agent, or Firm*—George C. Atwell

[57] ABSTRACT

A plier tool for single-handed manipulation to automatically adjust the tool jaws to positions of positive gripping and holding of any size workpiece within the jaw range has major body members constructed from laminations, providing a tool capable of exerting a balanced force on a workpiece. The construction of the tool also lends itself to automated and relatively inexpensive production and enables the user to quickly replace springs necessary for the function of the tool without requiring complete tool disassembly.

9 Claims, 3 Drawing Sheets

PLIER TOOL ASSEMBLY

This application is a continuation of U.S. patent application Ser. No. 07/804,911, filed Dec. 11, 1991, now abandoned.

BACKGROUND OF THE INVENTION

In my U.S. Pat. No. 4,651,598, issued Mar. 24, 1987, I introduced my new concept of utility pliers for single-handed manual manipulation capable of automatically adjusting to positions of positive gripping and holding of any size workpiece within the size range defined by the maximum opening between the jaws of the pliers. Thereafter, in my U.S. Pat. No. 4,662,252, issued May 5, 1987, I disclosed a structure for such pliers which, instead of the main body members being of forged steel construction, comprised body members of laminated sheet metal stampings with separating inserts which could be formed of plastic, and the handle area of the body members being adapted to contain springs required for the function of the tool.

SUMMARY OF THE INVENTION

The present invention relates to the provision of utility pliers having the capability of automatic self-adjustment, and more particularly pertains to improved construction for such pliers.

More specifically, in pliers of the type having a pair of pivotally connected first and second major body members with opposed gripping jaws and slot means in the first handle member enabling it to be slid relative to a pivoting element projecting into the slot from the second handle member and thereby vary the distance between the jaws, and wherein the pliers include biasing means operatively connecting the handle members and adapted to normally urge the handle members to slide relative to each other whereby the jaws are disposed to their widest open position, improved laminated structure is provided for the handle of major body members.

Continued experimentation and design work in regard to the construction of such plier tools has shown that such a tool constructed from laminated body members can be made virtually indestructible under normal use conditions and at much lower cost than forged steel construction. At most, the replacement of certain spring elements contained within the handle structures may be required should they lose their resiliency over time or perhaps even break. Replacement of such springs may then extend the use of the tool indefinitely. Hence, the present invention comprehands the provision of a laminated tool construction wherein spring removal and replacement can be easily accomplished without the need for complete disassembly of the tool.

A further object of the present invention is the provision of a unique fastener construction which joins the separate major body members to enable them to pivot and slidably adjust, one relative to the other, during the operative use of the tool.

A further object of the present invention is the provision of a plier tool capable of exerting a central balanced force against a workpiece grasped between the tool jaws. Unlike a forged tool where a slot is provided in the throat portion of one body member at an offset position to the other body member, the laminated construction of the tool in accordance with this invention provides spaced-apart twin-toothed slots or tracks, and the other body member is arranged to slide and pivot centrally within the spaced-apart sections of the first body member whereby a clamping force exerted manually on the handles of the tool causes a pair of oppositely-disposed pawls to simultaneously engage, each in its own toothed track whereby further manual force is translated along a centerline of the opposed tool jaws.

Other features and characteristics in accordance with the present invention will be understood and appreciated from the ensuing detailed description of the various figures in the drawings.

DETAILED DESCRIPTION OF THE PREFERRED EMBODIMENT

For a clear understanding of the function and operation of the disclosed tool structure, reference should be made to any or all of the prior issued patents as set forth earlier in the specification under the title "Background Of The Invention". The invention herein relates to the particular design and manufacture of a plier tool utilizing the unique function described in the earlier patents but here pertaining specifically to a tool which is constructed from stampings or laminations and the manner in which other operative components of the tool are mounted and interconnected to achieve a tool of superior strength and functional capability that can be produced for significantly reduced cost.

Figure 1:
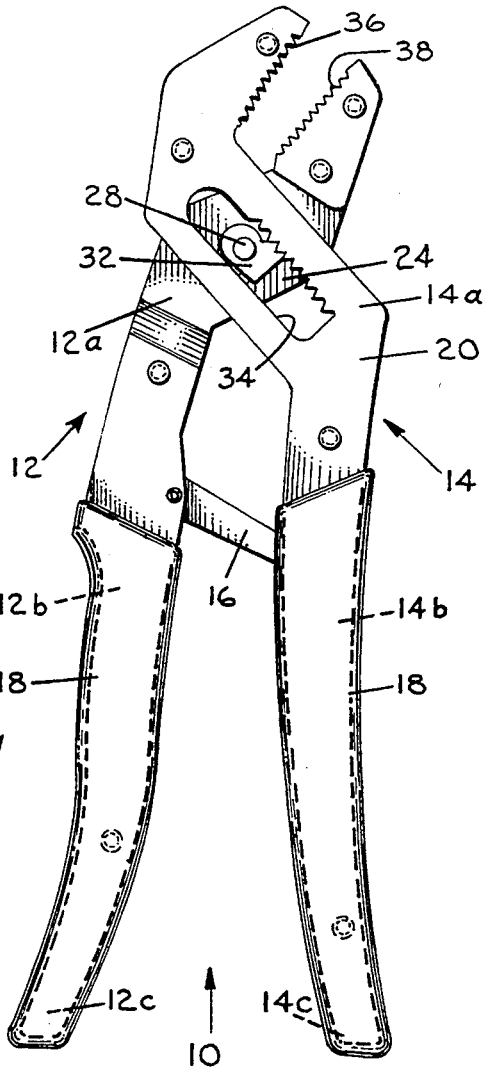
FIG. 1 is a side elevational view of the improved plier construction of the present invention.

FIG. 1 illustrates the presently preferred embodiment 10 of the plier tool assembly of the present invention. The tool 10 comprises major rigid body members 12 and 14 each being of laminated or layered construction. The two body members 12 and 14 are interconnected by a lever arm 16 and each has a handle portion **12*b* and 14*b* and respective distal ends 12*c* and 14*c*. Flexible grips 18 may be placed on rigid members as shown in FIG. 1**.

Figure 6:
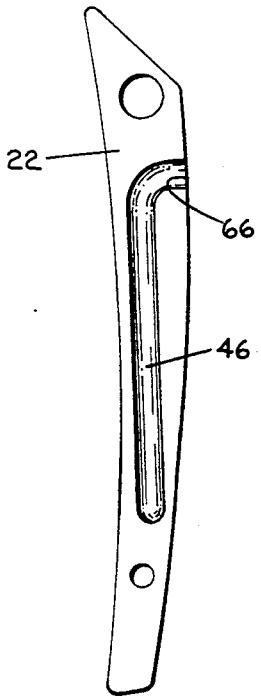
FIG. 6 is a first insert lamination utilized in forming a major body portion of the tool.
Figure 4:
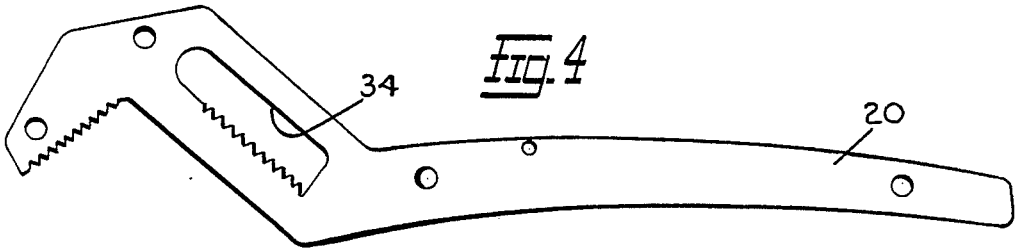
FIG. 4 is a metal stamping utilized in forming a major body portion of the tool.

FIG. 4 illustrates a stamped metal plate member 20, two of which are used to construct the body member 14. The body member 14 also has, between the two stamped metal plate members 20, a central layer or insert lamination 22 (illustrated separately in FIG. 6) that is preferably formed from a high density plastic composition.

Figure 7:
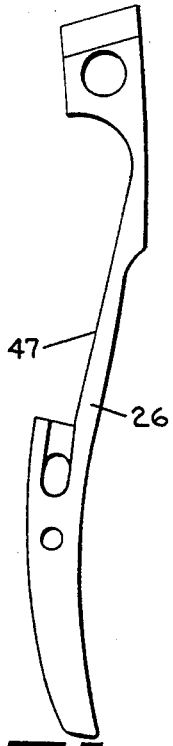
FIG. 7 is a second insert lamination utilized in forming a major body portion of the tool.
Figure 5:
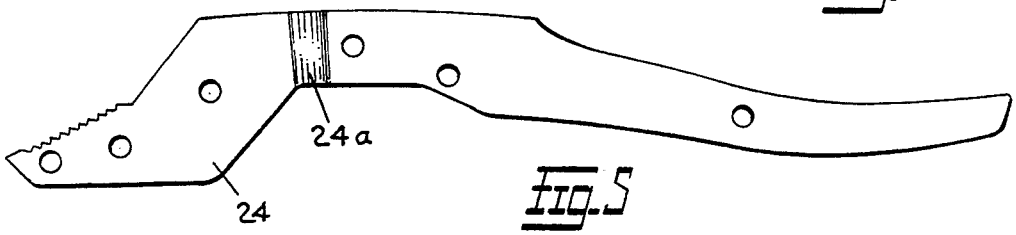
FIG. 5 is a metal stamping utilized in forming a major body portion of the tool.

The body member 12 is formed from a pair of stamped metal members 24, one of which is illustrated in FIG. 5. The stamped metal plate member 24 has an intermediate sloped portion 24*a* whereby a mirror-image stamped metal plate member, having an identical configuration to the member 24 except with an opposite intermediate sloped area, enables the use of an intermediate insert or lamination 26 (shown separately in FIG. 7) within the handle area of the bottom body member 12. At its upper jaw end, the body member 12 converges inwardly to the thickness of the two metal plates. Hence, the intermediate throat area of the body member 12 is slidably secured between the spaced-apart members 20 of the body member 14. The body member 14 has an open channel area 34 in each of the plate members 20 and a pawl 32 is mounted within the respective channel 34 on each side of the body member 12.

Figure 8:
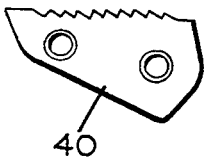
FIG. 8 and 9 illustrate, respectively, metal jaw plates or segments utilized in the structure of the tool.
Figure 9:
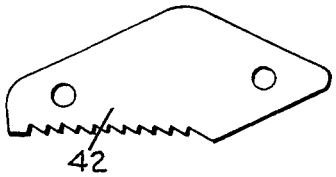
Figure 12:
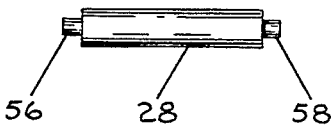
FIG. 12 is a side elevational view of a staking rod or shaft utilized as part of the fastening means of the present invention.
Figure 10:
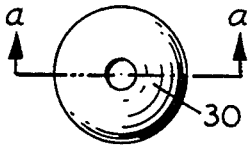
FIG. 10 is a top plan view of a retainer member forming part of a fastening means utilized in the tool of the present invention.
Figure 11:
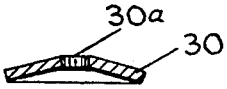
FIG. 11 is a sectional view taken along line a—a of FIG. 10.
Figure 13:
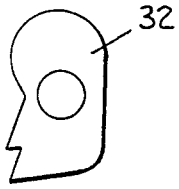
FIG. 13 is a side elevational view of a pawl utilized, in a pair, in the tool of the present invention.

The two body members 12 and 14 are secured at their throat portions by a fastener means which may comprise a staking rod or shaft 28 and a pair of oppositely-disposed retainer members 30. At the upper end 38 of the body member 12 a jaw end is formed by affixing thereto, with rivets, a pair of oppositely-disposed jaw segment plates, one of which is illustrated in FIG. 8. The upper end 36 of the body member 14 utilizes a jaw segment plate 42 secured between the spaced-apart stamped metal members 20.

Each retaining member 30 is preferably in the form of a disc-like conical washer whereby, in combination with the staking rod or shaft 28, permanent fastening of the two body members at their throat portions may be accomplished by a riveting operation using a tool adapted to spread the ends 56 and 58 within openings 30*a* of each retaining member 30. The binding force or tightness of the fastener is a function of a force applied in the riveting or staking operation. Moreover, if tolerances should differ between parts and it is found that the gripping force of the fastener, once riveted, is excessive and retards free pivot motion of the body members relative to each other, the design of the fastener means is such that a hammer blow on the outside face of one retaining member, with the other retaining member positioned on a flat anvil surface, will slightly flatten either or both of the retaining members from their conical shape toward a comparatively flat configuration whereby the binding effect of the fastener means is reduced.

Figure 14:
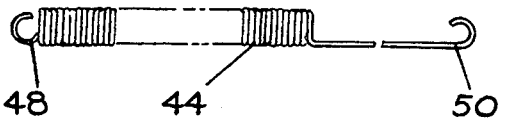
FIG. 14 is a wound extension spring utilized in the tool of the present invention.
Figure 15:
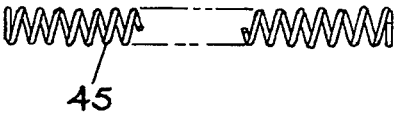
FIG. 15 is a wound compression spring utilized in the tool of the present invention.

Assembly of the tool 10 is completed by installation of a spring 44 (FIG. 14) and a spring 45 (FIG. 15). The spring 44 is an extension spring having end hooks 48 and 50, and this spring is utilized within a space 47 provided by the configuration of the insert lamination 26. The spring 45 is a compression spring which operates within a groove 46 in the insert lamination 22.

Figure 2:
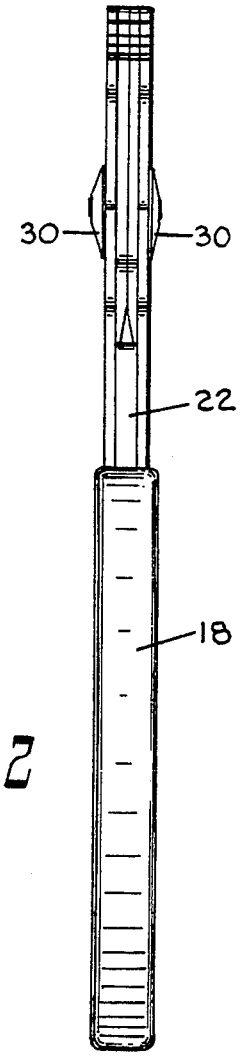
FIG. 2 is a front elevational view of the tool in FIG. 1, taken from the right side of FIG. 1.
Figure 3:
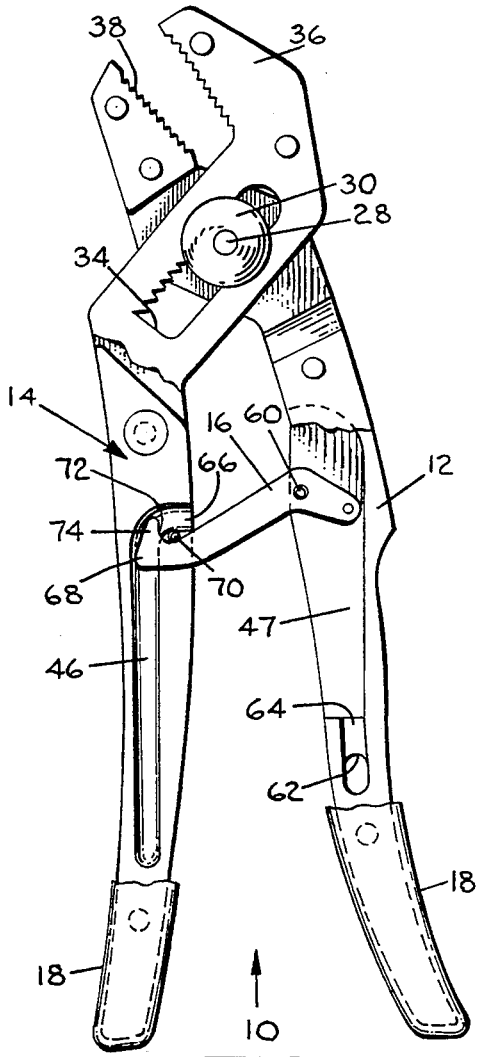
FIG. 3 is a side elevational view of the tool in accordance with the present invention, taken from the opposite side as compared to FIG. 1 and having certain portions of the tool handles cut away to reveal the internal construction of the tool.

The tool 10 shown in FIG. 3 is assembled by first forming the major body portions 12 and 14 with the inserts 22 and 26 riveted in place between the metal stampings 20 and 24 as heretofore explained. As part of that forming operation, a pair of the jaw segments 40 are riveted in place on opposite sides of the jaw end 38, providing a four thickness lamination as shown in FIG. 2. In the formation of the major body portion 14, a pair of the jaw segments 42 are aligned and riveted between the inner and outer metal stampings at jaw end 36. The body portions 12 and 14 are joined by first positioning a pawl 32 within each oppositely-disposed channel 34 and with the shaft 28 extending transversely to receive, at each of its ends, one of the retainer members 30. This fastening means is then staked by applying force to the two ends 56 and 58 of the shaft 28.

The next to last step in the assembly is installation of the lever arm 16 to the position shown in FIG. 3. A pivot pin 60 is driven through accommodating holes in the stampings 20 and 24, with the lever arm 16 contained therebetween. Then the spring 44 is installed into its operative position by inserting its hook 50 downwardly to engage through an opening 62 in the body of the lamination 47. It will be noted that a relatively thin-walled ramp 64 is provided upwardly adjacent the hole 62 to serve as a guide for insertably positioning the hook 50. The upper end hook 48 of the spring 44 is then engaged through a small aperture 66 adjacent one end of the lever arm 16. Then, with the handle ends of the tool 10 spread apart, the compression spring 45 is simply inserted into the opening 66 which leads to the recess or slot 46. Once the compression spring is in place in the slot 46, the pointed end 68 of the lever arm 16 can be inserted into the position shown in FIG. 3, over and above the upper end of the spring 45, and then the spring 45 will bias the lever arm end upwardly whereby an arcuate edge 72 adjacent a tooth portion 74 prevents the lever arm 16 from pulling out of position relative to a fixed transverse pin 70. The slide-on grips 18 can then be installed over the distal ends of the members 12 and 14 to complete the tool's construction.

The formation of the major body portions 12 and 14 can be by fully automated equipment, resulting in a significant cost savings. In the event the springs 44 and 45 should break or lose their resiliency over time, their replacement can be quite easily accomplished simply by slidably removing the grips 18. Then, the lever arm can be pivoted on pin 60 counterclockwise to move its end 68 downward so the handle ends can be moved apart and thereby pull the lever arm out of its inserted position relative to the pin 70. Then, either spring can be replaced in the manner heretofore described with regard to their original installation.

Manipulation of the pliers 10 to grip a workpiece is accomplished by the user grasping the handle portions 12*b* and 14*b* and by closing the hand thereabout and squeezing the handle portions toward each other. This action results in the member 12 pivoting clockwise on the pivot pin 60 whereby the jaw end 38 moves toward jaw end 36, and the pawl 32 advances in a sliding action up the channel or slot 34, as viewed in FIG. 1, until the jaws stop in contact with the workpiece. Contact of the jaws with the workpiece causes a pivoting motion between the throat portions 12*a* and 14*a* which action is translated to the pawl 32, causing it to move along the channel 34 and against the channel wall having the series of teeth 35. The tips of the teeth and that portion of the opposing wall which has no teeth present a coacting surface against which the camming surface 38 will contact and cause the pawl to pivot clockwise whereby its tip will engage in a notch between two of the teeth and perform a locking action against further sliding action between throat portions 12*a* and 14*a*. Continued manual pressure against the handle portions will then cause the jaw ends to tightly grip the workpiece.

The pawl 32, the bolt or rod 28, and the interaction of the pawl 32 with the specially configured slot 34 constitutes a fastening means connecting the members 12 and 14 between the throat portions 12*a* and 14*a* and whereby the jaw ends 36 and 38 will close toward each other and grip a workpiece between them in response to manual closing force being applied on the handle portions. This fastening means includes sliding and pivotal structure adapted to first slide the throat portion 12*a* relative the throat portion 14*a* to move the jaws 36 and 38 toward each other in a workpiece gripping action. The fastening means next acts to lock the throat portions against further sliding action and simultaneously triggers a pivotal action, in response to the jaws' contacting the workpiece therebetween. Then, increased exertion manually on the handle ends operates through the pivotal structure of the fastening means as a gripping force directed against the workpiece by the jaw ends.

Release of the manual gripping pressure on the handle ends permits the control or lever arm to be biased against pin 60 (FIG. 3) which action translates as an automatic opening action whereby the jaw ends move to their fully open disposition readily disposed for the next use in automatically adjusting and gripping a nut, pipe, or other object of any size equal to or smaller than the maximum distance between the fully open jaws.

While the foregoing description has shown and described the fundamental novel features as applied to the preferred embodiment of the improved plier tool assembly of the present invention, it will be understood by those skilled in the art that modification embodied in various forms may be made without departing from the spirit and scope of the invention.

I claim:

1. A plier tool comprising:

first and second rigid members, each having a handle portion, a throat portion, a jaw end, and a distal end, the members being joined in a scissors-like arrangement whereby the jaw ends are caused to move toward each other in response to the handle portions being moved toward each other;

the first rigid member being of laminated construction wherein its handle portion comprises a plurality of substantially flat lamination, including at least one inner lamination secured between oppositely-disposed outer laminations;

means between the outer laminations for guidably positioning a spring, comprising a groove in the inner lamination and extending substantially longitudinal within the handle portion of the first rigid member;

a first end of the groove terminating within the handle portion of the first rigid member and at a point toward the first rigid member's distal end; and a second end of the groove constituting an arcuate section terminating as an opening on a surface of the first rigid member and oriented toward the second rigid member; and the second rigid member being of laminated construction wherein its handle portion comprises a plurality of substantially flat laminations, including at least one inner lamination secured between oppositely-disposed outer laminations.

2. The plier tool of claim 1 wherein the handle portion of the second rigid member has a space between its outer laminations which is open in a direction toward the opening on an outer surface of the handle portion of the second rigid member.

3. The plier tool of claim 2, further comprising a compression spring contained within the groove.

4. The plier tool of claim 2 wherein an extension spring is contained within the space between the outer laminations of the second rigid member.

5. The plier tool of claim 3 wherein a lever arm extends between the respective handle portions of the rigid members whereby a first end of the lever arm projects into the space of the second rigid member.

6. The plier tool of claim 4 wherein the first end of the lever arm is operatively connected to an end of the extension spring.

7. The plier tool of claim 5 wherein the second end of the lever arm is forced in a direction opposite to the distal end of the first rigid member by the compression spring.

8. The plier tool of claim 5 wherein the first end of the lever arm is pivotally joined to the second rigid member by a pivot pin extending between the outer laminations of the second rigid member and across the space provided therebetween.

9. The plier tool of claim 7 wherein the first rigid member has a transverse pin extending between its inner and outer laminations, and the second end of the lever arm is normally caused to press against said transverse pin by the compression spring.

* * * * *